US005246415A

United States Patent [19]

Fuss

[11] Patent Number: 5,246,415

[45] Date of Patent: Sep. 21, 1993

[54] BUCKLE CHUTE FOLDING MACHINE

[75] Inventor: Manfred Fuss, Tennenbronn, Fed. Rep. of Germany

[73] Assignee: Mathias Bauerle GmbH, Georgen, Fed. Rep. of Germany

[21] Appl. No.: 872,538

[22] Filed: Apr. 23, 1992

[30] Foreign Application Priority Data

Apr. 30, 1991 [DE] Fed. Rep. of Germany ..... 4114105

[51] Int. Cl.[5] ..... B65H 45/14

[52] U.S. Cl. ..... 493/28; 493/29; 493/420; 493/421

[58] Field of Search ..... 493/1, 2, 11, 28, 29, 493/419, 420, 421

[56] References Cited

U.S. PATENT DOCUMENTS

| | | | |
|---|---|---|---|
| 3,516,655 | 6/1970 | Schmeck | 493/421 |
| 3,788,638 | 1/1972 | Lehmann | 271/51 |
| 3,856,293 | 12/1974 | Boyer | 493/421 |
| 4,586,704 | 5/1986 | Lehmann et al. | 270/46 |
| 4,601,695 | 7/1986 | Pazzi | 493/418 |
| 4,621,966 | 11/1986 | Luperti et al. | 414/43 |
| 4,647,029 | 3/1987 | Ohmori | 270/45 |
| 4,850,945 | 7/1989 | Whittenberger | 493/14 |
| 4,898,570 | 2/1990 | Luperti et al. | 493/420 |

FOREIGN PATENT DOCUMENTS

| | | | |
|---|---|---|---|
| 595776 | 4/1934 | Fed. Rep. of Germany | 493/421 |
| 673176 | 3/1939 | Fed. Rep. of Germany . | |
| 2738689C3 | 5/1981 | Fed. Rep. of Germany . | |
| 3621157A1 | 1/1987 | Fed. Rep. of Germany . | |
| 3840856A1 | 7/1989 | Fed. Rep. of Germany . | |
| 3830656C1 | 11/1989 | Fed. Rep. of Germany . | |
| 226037 | 6/1943 | Switzerland . | |
| 458405 | 6/1968 | Switzerland | 493/421 |

*Primary Examiner*—William E. Terrell
*Attorney, Agent, or Firm*—McGlew and Tuttle

[57] ABSTRACT

A buckle folding machine with one or several folding roller pairs (W1/W2, W2/W3, W3/W4, W4/W5) and one or several folding pockets (T1, T2), which are associated with the individual folding station (F1 through F4) and which each have a paper stop (10, 11/1, 12, 13), which can be set to different feed lengths. To also collect and jointly fold a plurality of sheets of paper (1), at least one folding pocket (T2) is designed for simultaneously receiving a plurality of sheets of paper (1) such that the individual sheets of paper (1) are able to run in automatically up to the paper stop (11/1) over their full length and remain there. A pushing device is provided (3) which performs impulse-like stroke movements by means of a special drive (31) controlled by a presettable sheet counting device (18) or code-reading device (24). These stroke movements cause the sheets of paper collected in this folding pocket (T2) to be delivered together into the next folding station (F2).

10 Claims, 2 Drawing Sheets

BUCKLE CHUTE FOLDING MACHINE

FIELD OF THE INVENTION

The present invention pertains to a buckle folding machine with one or several folding roller pairs, each forming a folding site, and with one or more folding pockets associated with the individual folding sites, which folding pockets have a paper stop each, which can be adjusted with its stop surface to stop planes that correspond to different feed lengths.

BACKGROUND OF THE INVENTION

While the prior-art buckle folding machines of this class are usually used to fold sheets of paper passing through one by one, devices for collecting and folding sheets of paper are also known, in which a plurality of sheets of paper are collected in a collection station that is provided with an electronic sheet counting device presettable to different count values, and they are subsequently folded together in a folding mechanism provided with at least one folding roller pair and one folding blade.

Such devices are used, among other things, to jointly fold sheets of paper which are fed in from, e.g., a printing press and contain related information, and then to subsequently feed them to another processing station, e.g., an enveloping machine, for further processing.

In these prior-art devices, the collection station is arranged directly next to a folding machine, and the folding machine usually has an intake device for taking in together the sheets of paper collected in the collection station. One peculiarity of such a folding machine is that besides the folding pockets, it has, in front of each folding site, a folding blade or sword, by which the sheets are deflected together into the corresponding folding site for fold formation. Folding machines with such folding blades have been known from, e.g., DE 3,840,856 A 1 or DE 3,830,656 C 1.

Another peculiarity linked with a folding machine using such a collection station is that at least one folding roller of one folding roller pair is mounted elastically in relation to the other and/or can be set to different distances to permit correspondingly different folding gap widths to be set for folding a plurality of sheets or a plurality of sheet layers.

However, buckle folding machines of this class, whose folding rollers are provided with an elastic jacket and in which it is therefore possible not to use a radially elastic mounting of the folding rollers, have been known as well (see U.S. Pat. No. 3,788,638). However, more accurate folding can be achieved, in the case of the simultaneous folding of a plurality of sheets of paper, with radially elastically mounted folding rollers that can be adjusted to defined folding gap widths.

SUMMARY AND OBJECTS OF THE INVENTION

It is a primary object of the present invention to design a buckle folding machine of the type noted above as simply as possible such that it is suitable for use both as a conventional folding machine for folding sheets of paper passing through one by one and for collecting and jointly folding a plurality of sheets of paper.

This object is attained according to the present invention by a folding pocket which is designed to receive simultaneously a plurality of sheets of paper and is arranged and designed such that the individual sheets of paper run into the folding pocket automatically over their entire length and can remain in it, having a pushing device which performs—by means of a special drive controlled by a presettable sheet counting device or code reading device—pulse-like lifting movements by which the sheets of paper actually collected in that folding pocket will be fed together to the subsequent folding site.

The term "special drive" is intended to express that it does not influence an adjusting drive which may be present and with which the paper stop of a folding pocket can be automatically set to defined feed lengths.

In the collection stations of the prior-art devices for collecting and folding a plurality of sheets of paper, the runs of endless conveyor belts or delivery belts are arranged in a horizontal plane one above another and next to one another, and these belts deliver the individual sheets of paper to a stop located in the feed web and consequently extend over the entire length of the collection station. In addition, additional conveying means and/or additional control units are needed for jointly feeding the collected sheets from the collection station into the folding machine, and it also must be ensured that the collected sheets of paper can be transported into the folding machine past the stop of the folding station, which can be achieved either by lifting the collected sheets over the stop or by removing the stop from the collection plane.

The special advantage of the solution according to the present invention is that the entire mechanism and control unit of the collection station described is dispensed with and that its task is assumed by the folding pocket of the folding machine, which is present anyway. The pushing device that is additionally needed for this task can be designed, as will be explained in greater detail, in various ways in a simple manner, such that it does not require additional space. The only common requirement for all embodiments is such an arrangement, e.g., the inclination provided for the folding pocket (of at least 30°) serving as a collecting shaft, that the sheets of paper to be collected will automatically run to the stop surface from a folding station or intake site located in front of the folding pocket, and they will remain there in the stop position, because the individual sheets of paper must not be under the influence of a delivery drive when they arrive at the stop surface.

A first embodiment of the pushing device that is certainly the simplest and offers the best performance comprises a pushing member arranged in the area of the stop surface of the paper stop and that this pushing member can be deflected in the discharge direction in relation to the stop plane set by means of an electromagnetic drive.

While it is possible to arrange the pushing member and, if desired, even its drive means fully within the folding pocket, the feature of the first embodiment including a pushing device comprised of a pivoted lever which extends into the folding pocket in the area of the stop surface has the advantage that its functioning parts can be installed more easily, are more readily accessible, and are also more reliable in operation. The further feature of the first embodiment, wherein pivoted lever itself forms the stop surface, leads to a further simplification.

It is possible in all types of embodiment to set the paper stop of the folding pocket serving as a collecting shaft to the actual sheet lengths or to the feed lengths corresponding to a defined type of folding, so that it is possible not only to collect sheets of paper of different lengths, but also to process them one by one with different types of folding.

According to a second embodiment of the present invention, the pushing device consists of a stop support extending in the longitudinal direction of the folding pocket, on which the paper stop for setting different feed lengths is adjustably fastened and which can be moved from a resting position in the discharge direction in a stroke-like manner by means of an electromagnetic drive. Stroke movements or stroke-like movements are defined as reciprocating movements, after which the member performing them returns into its starting position.

The advantage of this second embodiment is that the paper stop itself has a very simple design and can be adjustable for manually or automatically setting different feed lengths.

One highly significant advantage that can be achieved with these first and second embodiments of the present invention is the fact that sheets of paper can be continuously fed into the buckle folding machine, i.e., it does not need to be interrupted, precisely while the sheets of paper collected in one folding pocket are running together through the subsequent folding site. During this time, a new sheet of paper can run into this collecting and folding pocket in these embodiments of the pushing device.

In a third embodiment of the invention, the pushing device comprises a rotationally driven drive member that can be briefly pivoted into the folding pocket in a stroke-like manner by the special drive from the upper flat side.

This third variant also has an advantage, namely, that in a conventionally equipped buckle folding machine, the existing paper stop can remain unchanged, which is significant especially in the case of a paper stop that is automatically adjustable by means of a microprocessor.

As is apparent from the feature of the third embodiment wherein the drive roller is mounted on a pivoted lever that can be actuated electromagnetically and wherein the drive roller is frictionally engaged with a folding roller (and driven thereby), positioned above the folding pocket intake, this embodiment of the present invention can also be realized in a simple manner, and it is also ensured in a simple manner that the drive roller will be driven at the circumferential speed of the folding rollers.

One additional advantage of all embodiments of the present invention is that the folding pocket equipped with the pushing device can also be used to turn individual sheets of paper.

Still another object of the invention is to provide a buckle folding machine, which can fold single sheets and also can collect and jointly fold a plurality of sheets, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figures 1, 2:
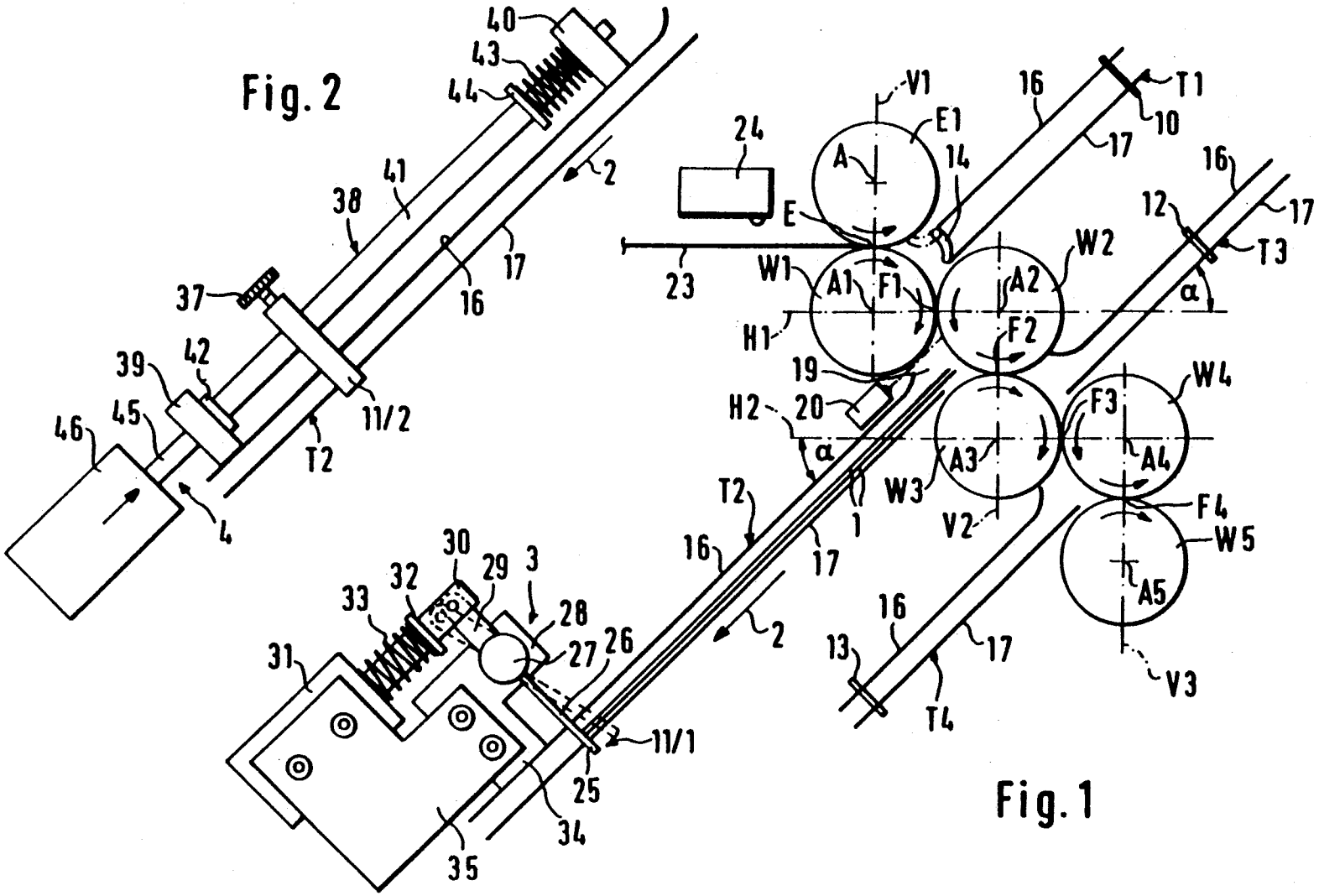
FIG. 1 is a schematic simplified representation of a side view of a buckle folding machine with four folding roller pairs, four folding stations, and four folding pockets.
FIG. 2 is a schematic simplified side view of a folding pocket with another pushing device.

The buckle folding machine shown has, on the whole, an intake roller E1 and five folding rollers W1, W2, W3, W4, and W5, which form in pairs an intake site E and four folding stations F1, F2, F3, and F4. While the intake roller E1 is mounted in rigid roller bearings, the folding rollers W1 through W5 are mounted radially elastically in relation to the adjacent intake roller E1 or the folding roller W1 through W4, with which they form an intake site E or the respective folding stations F1 through F4.

The intake roller E1 and the folding rollers W1 through W5 are arranged such that their axes, A, A1, A2, A3, A4, and A5 each are located in the corners of an isosceles right triangle, and the axes A and A1, A2, and A3 as well as A4 and A5 are each located in vertical planes V1, V2 and V3, respectively, while the pairs A1 and A2 as well as A3 and A4 each are located in horizontal planes H1 and H2, respectively.

The buckle folding machine also has four folding pockets T1, T2, T3, and T4, which are associated with the individual folding sites F1 through F4 and each of which enclose an inclination angle alpha ($\alpha$) of about 45° with the respective horizontal planes H1 and H2, and which are individually provided with paper stops 10, 11, 12, and 13, respectively, which can be adjusted to different feed lengths. This inclination angle alpha implies that the two folding pockets T1 and T3 each extend obliquely in the upward direction in the intake direction, while the other two folding pockets T2 and T4 are inclined in the downward direction in the intake direction indicated by the arrow 2, so that the sheets of paper 1 arriving from the folding station F1 and F3 will completely run into the respective folding pockets T2 and T3 even if their respective paper stops 11 and 13 are set to a feed length that is greater than the longitudinal format of the sheet of paper 1. This means that these folding pockets T2 and T3 inclined in the downward direction in the intake direction are suitable for collecting a plurality of sheets of paper without any problem by setting their paper stops to a feed length that is greater than the longitudinal format of the arriving sheet of paper 1. To have the possibility, if desired, to also fold the collected sheets of paper 1, it is advantageous to use the second folding pocket T2 as a collecting pocket for collecting sheets of paper, and provisions have also been made for such use.

The inclination of the folding pocket T2, i.e., the inclination angle alpha, must be selected such that the sheets of paper 1 arriving from the folding station F1 will automatically strike the paper stop 11 (FIG. 3) with certainty and will remain lying in contact with it. Consequently, the inclination angle alpha does not have to be exactly 45°; it may also be smaller under certain circumstances.

If the speed of delivery is high enough, it is possible to select a very gentle slope for the folding pocket F2, i.e., the angle alpha may be selected to be small. However, higher accuracy of work is achieved with steeper inclination of the folding pocket F2, because rebound of the material to be folded, which strikes the paper stop 11 at a high speed, can thus be better avoided than in the case of a flatter arrangement.

The folding pockets T1 through T4 each consist of upper and lower, rod-shaped guide members 16 and 17, which are put together in a grid-like manner and avoid two-dimensional contacts with the material to be folded.

At least the folding pocket T1 is provided, on the intake side, with a sheet deflector 14, which can be pivoted from a deflecting position indicated in solid line in the drawing into a resting position represented in dash-dotted line, in which it releases the folding pocket T1. In the deflecting position of the sheet deflector 14 as shown, the sheets of paper 1 arriving from the intake site E are guided, past the first folding pocket T1, directly into the folding station F1, from which they will subsequently run into the second folding pocket T2. The other folding pockets are usually also provided with such sheet deflectors.

The paper stops 10 through 13 can be set manually or by means of an electronically controlled setting device to different format lengths or different feed lengths for different types of folding in the known manner.

Figure 3:
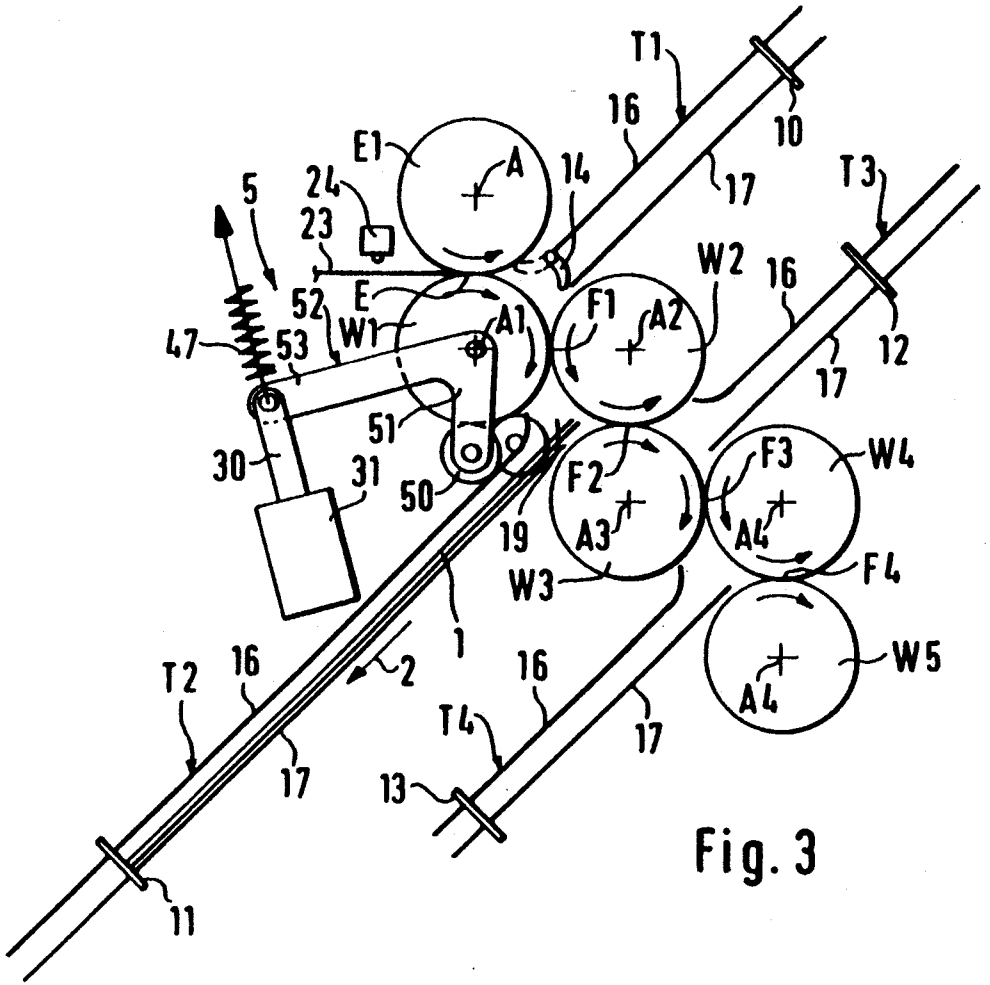
FIG. 3 is a schematic simplified representation of a side view of the buckle folding machine according to FIG. 1 with another pushing device.

In the embodiment shown in FIG. 3, which has a special pushing device 5 arranged at a distance from the paper stop 11, the paper stop 11 of the second folding pocket T2, which is used as a collection shaft, is also designed in the usual manner, i.e., like the paper stops 10, 12, and 13 of the other folding pockets T1, T3, and T4. In contrast, in the embodiments according to FIGS. 1 and 2, the paper stops 11/1 and 11/2, respectively, are provided, such that they are themselves part of a respective pushing device 3 and 4. These the pushing devices 3, 4, and 5 are necessary to feed sheets of paper, which have entered the folding pocket T2 over their entire format length and can no longer be grasped by the folding rollers W2 and W3 in this position, into the next folding station F2.

Figure 4:
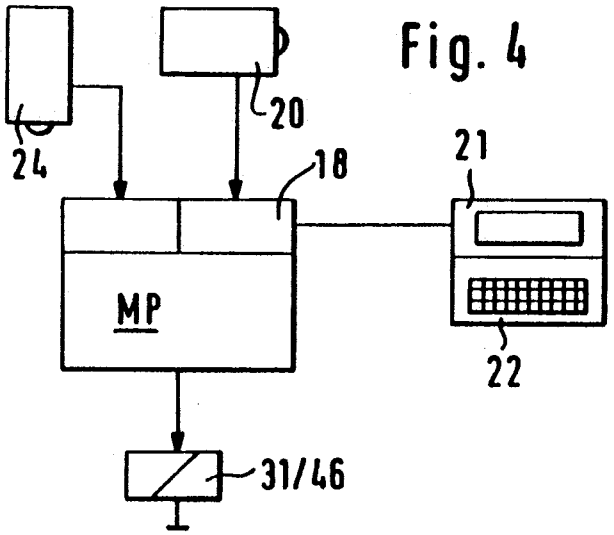
FIG. 4 is a simplified block diagram.

To make it possible to collect a defined number of the sheets of paper 1 in the folding pocket F2, an electronic sheet counting device 18 (see FIG. 4), which consists of a reflected light scanner 20 (see FIG. 1) arranged in the intake opening 19 of the folding pocket T2 and a presettable coincidence counter with a value display device 21 and an input device 22, is provided. The coincidence counter is integrated in a microprocessor MP and can be set to the desired number of sheets of paper to be collected in the folding pocket T2. When the preset sheet count is reached in the folding pocket F2, it generates a triggering impulse to actuate the pushing device 3, 4 or 5.

Instead of or in addition to the sheet counting device 18, a code-reading device 24 (see FIG. 3) may be arranged in a feed web 23 arranged in front of the intake site E. The code-reading device 24 is able to read a code marking (e.g. bar code etc.) that marks the last sheet of paper in the amount of sheets to be collected and to generate a command for actuating the pushing device 3, 4 or 5 on reading this mark or code.

In the embodiment shown in FIG. 1, the paper stop 11/1 consists of a pivoted lever 25, which extends vertically into the folding pocket T2 from the top flat side. The front side of the pivoted lever 25 forms the stop surface 26, with which the sheets of paper 1 arriving in the folding pocket 2 from the folding station F1 are in contact. The pivoted lever 25 is fastened to a shaft 27 which is rotatably mounted in an angular stop support 28 and is in hinged connection with the pulling armature 30 of an electromagnet 31 via a lever 29. The pulling armature 30 is under the influence of a restoring spring 33, which partially surrounds it, is supported on a lock washer 32, and holds the pivoted lever 25 in its resting position or stop plane 34 perpendicular to the folding pocket T2. The electromagnet 31 is rigidly connected by a post to the stop support 28 and is manually or automatically adjustable, together with it, to different feed lengths, which can correspond to different format lengths of the material to be folded or to different types of folding.

When the stop support 28 is set, as shown in FIG. 1, to a feed length that is a few millimeters larger than the format length of the arriving sheet of paper 1, a plurality of the sheets of paper 1 can be collected in the folding pocket T2, and the number of these sheets of paper can be preselected manually by means of the sheet counting device 18 (see FIG. 1), or it can be determined by a code marking that is arranged on the last sheet of paper of a number of sheets of paper to be collected and is read by the code reader 24 (see FIG. 3) to generate an energizing impulse for the electromagnet 31. Due to the electromagnet 31 being energized, the pivoted lever 25 performs a counterclockwise pivoting movement around the axis of the shaft 27, by which the sheets of paper 1 lying in the folding pocket T2 are moved together in the discharge direction and are pushed into the folding station F2 in the process. They are then grasped by the folding roller W2 and W3 there and are fed, folded or unfolded, depending on the setting of the folding pockets T3 and T4, through the further folding stations F3 and F4.

Since the deflecting movement of the pivoted lever 25 takes place as a stroke-like movement, i.e., in a short time, and the pivoted lever 25 very rapidly returns into its resting position or into the stop position 34, a new sheet of paper 1 can run into the folding pocket T2 from the folding station F1 while the sheets of paper 1 previously collected are being pulled out of the folding pocket T2. Consequently, there is no need to interrupt the feed of sheets of paper after conclusion of a collection process.

FIG. 2 shows only the folding pocket T2 with another pushing device 4 on a slightly larger scale, but this folding pocket can be put in the place of the folding pocket T2 shown in FIG. 1 with the pushing device 3. In this the pushing device 4 shown in FIG. 2, a paper stop 11/2, which extends vertically into the folding pocket T2, is designed as a transversely extending rail, and is detachably fastened to a stop support 38 by means of a locking screw 37. The stop support consists of a rod 41, which is axially displaceably mounted in two bearing blocks 39 and 40, is in contact with a collar 42 in its resting position on the bearing block 39, and is under the influence of a restoring spring 43, which is in contact with the bearing block 40, on the one hand, and with a lock washer 44, on the other hand, and concentrically surrounds the rod 41 in this area.

The rod 41 is in connection with the pulling armature 45 of an electromagnet 46, which is energized in a pulse-like manner by the sheet counting device 18 or the code reader 24 analogously to the control of the electromagnet 31, so that it also performs a brief stroke movement, by which the sheets of paper 1 collected in the folding pocket T2 are fed together into the folding station F2.

Together with the stop 11/2 attached to it, the rod 41 always performs the same short stroke movements. However, the stop 11/2 can also be fixed in any position on the rod 41 by means of the locking screw 37 between the collar 42 and the lock washer 44, i.e., it can be set to any feed length.

In the embodiment according to FIG. 3, the paper stop 11 of the folding pocket T2, which is used as a collecting pocket, has the same design as the paper stops 10, 12, and 13 of the folding pockets T1, T3, and T4, and this paper stop can be set to different feed lengths in the same manner as in the case of conventional buckle folding machines, which can be done manually or automatically by means of a microprocessor.

A drive roller 50, which can be pivoted into the folding pocket T2 from the top flat side in the area of the intake opening 19, is provided as the pushing device. This drive roller, designed as a friction roller, is in frictionally engaged connection with the folding roller W1 and is rotatably mounted on an arm 51 of a two-armed pivoted lever 52. The pivoted lever 52 is in turn pivotably mounted coaxially with the axis A1 and is in hinged connection via its second, longer lever arm 53 with the pulling armature 30 of a the electromagnet 31, which is held in its resting position shown in FIG. 3 by a restoring spring 47 designed as a draw spring.

When the electromagnet 31 receives a lifting impulse generated by either the sheet decollator 18 or the code reader 24, the drive roller 50, which rotates at the same circumferential velocity as the folding rollers W1 through W5, is pivoted from the top flat side into the folding pocket T2, so that the sheets of paper lying in this folding pocket T2 will be grasped by it and carried into the folding station F2. Pressing the feed roller 50 onto the stack of paper in the folding pocket T2 only briefly is sufficient to bring about the desired effect.

While specific embodiments of the invention have been shown and described in detail to illustrate the application of the principles of the invention, it will be understood that the invention may be embodied otherwise without departing from such principles.

While specific embodiments of the invention have been shown and described in detail to illustrate the application of the principles of the invention, it will be understood that the invention may be embodied otherwise without departing from such principles.

What is claimed is:

1. A buckle folding machine, comprising:

a plurality of roller pairs including a first and second roller cooperating to form a sheet intake site for feeding in individual sheets and at least an additional roller cooperating with said second roller to form a folding station;

a folding pocket associated with said folding station, said folding pocket including a paper stop which may be adjusted to a stop surface position to form a stop plane corresponding to a sheet feed length, said stop surface being positionable at a location spaced from a folding pocket intake by a distance for receiving a full length of each sheet in said folding pocket thereby allowing receipt of a plurality of sheets for maintaining a plurality of sheets in said folding pocket;

pushing means for pushing the sheets out of said folding pocket, said pushing means being associated with said folding pocket; and presettable sheet counting means for determining a number of sheets delivered to said folding pocket and maintained therein and for controlling said pushing means to eject said sheets when a predetermined number of sheets has entered said folding pocket.

2. A buckle folding machine according to claim 1, wherein said at least one folding pocket, with said pushing means, is inclined downwardly by an inclination angle of at least 30° in an intake direction, with relation to a horizontal plane.

3. A buckle folding machine according to claim 1, wherein said pushing means comprises a pushing member arranged as said paper stop, said electromagnetic drive driving said pushing member in a discharge direction from said stop plane.

4. A buckle folding machine according to claim 1, wherein said pushing means comprises a pivoted lever pivotably mounted on a paper stop support and extending into said folding pocket, and an electromagnetic drive for actuating said pushing means independently of the positioning of said paper stop support for different feed lengths.

5. A buckle folding machine according to claim 4, wherein said pivoted lever itself forms said stop surface in a resting position.

6. A buckle folding machine according to claim 1, wherein said pushing means comprises a stop support, extending in a longitudinal direction of said folding pocket, said paper stop being fixed on said stop support, adjustably to set different feed lengths, said stop support being moved in a stroke-like manner in a discharge direction from a resting position, by an electromagnetic drive.

7. A buckle folding machine according to claim 1, wherein said pushing means comprises a rotatably arranged drive member pivotably in a stroke-like manner from a rest position, to a drive position in said folding pocket.

8. A buckle folding machine according to claim 7, wherein said drive member comprises a drive roller mounted on a pivoted lever, said lever being pivotable by said special drive means, said special drive means comprising an electromagnetic drive, said drive roller being held by said pivoted lever in frictional engagement with a folding roller, arranged above an intake of said folding pocket, said pivoted lever being mounted coaxially with an axis of said folding roller.

9. Buckle folding according to claim 1, wherein said counting means includes a code reading device for reading codes of individual sheets for indicating a number of sheets collected in said folding pocket for control of said pushing device and said pushing device includes an electromagnetic drive.

10. A buckle folding machine, comprising:

a plurality of roller pairs including a first and a second roller pairs forming a sheet intake site for feeding in individual sheets, an additional roller cooperating with said second roller to form a folding station and an additional roller pair forming an additional folding station;

a folding pocket associated with each of said folding station and said additional folding station, each said folding pocket including a paper stop which may be adjusted to a stop surface position to form a stop plane corresponding to a sheet feed length, at least one said folding pocket including a stop surface which is positionable at a location for receiving a full length of each sheet thereby allowing receipt of a plurality of sheets for maintaining a plurality of sheets in said at least one said folding pocket;

pushing means for pushing the sheets out of said at least one said folding pocket, said pushing means being associated with said folding pocket and including an electromagnetic drive; and presettable sheet counting means for counting sheets delivered to said at least one said folding pocket and maintained therein and for controlling said pushing means to eject said sheets when a predetermined number of sheets has entered said at least one said folding pocket.

* * * * *